United States Patent [19]

Rabb et al.

[11] Patent Number: 4,974,034

[45] Date of Patent: Nov. 27, 1990

[54] POST-COLLATION DUPLEX COPYING SYSTEM

[75] Inventors: Khalid M. Rabb, Webster; John W. Daughton, Rochester; Gary L. Hutchinson, Fairport; William P. Kukucka, Webster, all of N.Y.

[73] Assignee: Xerox Corporation, Stamford, Conn.

[21] Appl. No.: 446,243

[22] Filed: Dec. 5, 1989

[51] Int. Cl.[5] ..... G03G 21/00

[52] U.S. Cl. ..... 355/319; 271/3.1; 355/313; 355/320; 355/323

[58] Field of Search ..... 355/313, 318, 319, 320, 355/323; 271/3.1

[56] References Cited

U.S. PATENT DOCUMENTS

| | | | |
|---|---|---|---|
| 4,212,457 | 7/1980 | Guenther | 271/288 |
| 4,278,344 | 7/1981 | Sahay | 355/320 X |
| 4,285,591 | 8/1981 | Botte et al. | 355/319 X |
| 4,361,320 | 11/1982 | Kikuchi et al. | 271/288 |
| 4,444,491 | 4/1984 | Rinehart et al. | 355/323 X |
| 4,579,326 | 4/1986 | Pinckney et al. | 271/3.1 |
| 4,782,363 | 11/1988 | Britt et al. | 355/319 X |
| 4,830,590 | 5/1989 | Sumikawa et al. | 418/96 |
| 4,834,360 | 5/1989 | Acquaviva | 271/3.1 |

FOREIGN PATENT DOCUMENTS

| | | | |
|---|---|---|---|
| 0020759 | 2/1982 | Japan | 355/323 |
| 0066273 | 3/1987 | Japan | 355/319 |
| 0073358 | 3/1989 | Japan | 355/323 |

*Primary Examiner*—A. T. Grimley
*Assistant Examiner*—Thu A. Dang

[57] ABSTRACT

An improved post-collation duplex to duplex copying system, for a duplexing copier with a duplex buffer tray, and connected sorter bins, utilizing a recirculating duplex document handler (RDH) in which a set of duplex (two sided) original document sheets may be loaded, recirculated, copied, and inverted during circulations, for making plural duplex (two sided) copy sheets, by temporarily storing a calculated variable plural number of identical consecutive first side copies of each document in the duplex tray and feeding these copy sheets out from the duplex tray for copying their second sides in a subsequent document circulation, and outputting them to selected sorter bins, in which the plural identical copies are collated in a calculated variable number of sorter bins normally substantially less than the total number of bins. This variable number of identical copies made per document in a circulation and bins utilized per circulation is preferably a repeatedly recalculated function of the smallest of: (1) the duplex tray capacity ÷ number of originals being copied, or (2) the quantity of copy sets selected, or (3) the number of available sorter bins, or (4) the remaining quantity of copy sets to be made.

7 Claims, 3 Drawing Sheets

Figures 1A, 1B:
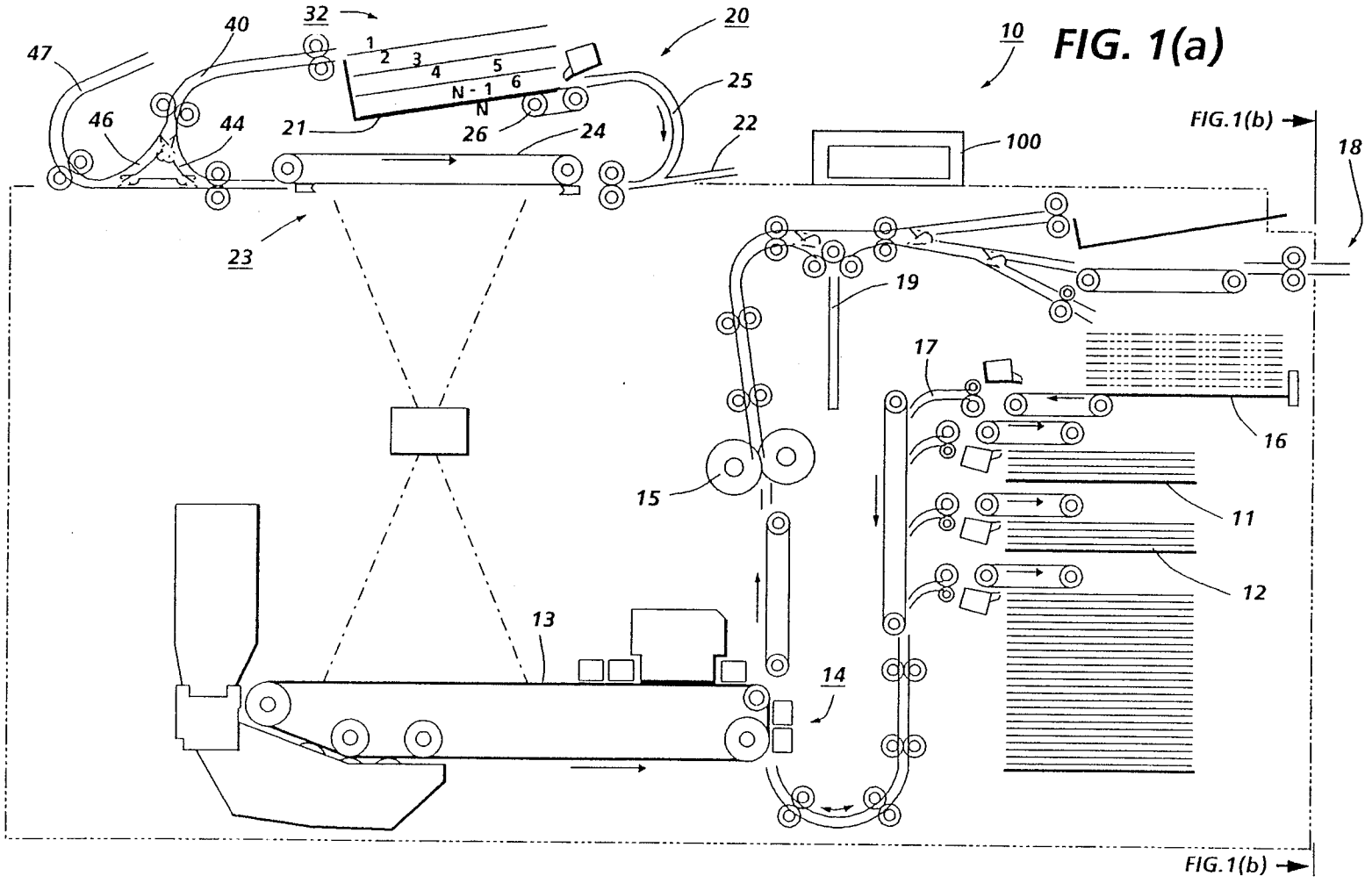

10
100
18

16
11
12
17
19
14
15
13
20
25
22
24
26
N
N-1
6
5
4
3
2
1
32
21
23
40
44
46
47

POST-COLLATION DUPLEX COPYING SYSTEM

The present invention relates to an improved system of automatic production of duplex copy sheets in a copier with an automatic recirculating document handler and operatively connecting plural sorter or collator bins for post-collation duplex copying.

The present system is usable with conventional or other xerographic or other photocopiers and conventional or other automatic recirculating document handlers, and can reduce the number of recirculations of the document sheets by the recirculating document handler for many copying jobs.

There is disclosed herein an improvement in original document handling and duplex copying for copiers, in which duplex (two sided) originals can be duplex copied in a conventional duplexing copier with a duplex buffer tray with conventional and/or commercially available recirculating document handlers (RDH's) in which the duplex documents are inverted during their circulation and restacked in the RDH document restacking tray (rather than being immediately inverted and immediately copied on their opposite or second side), yet in which plural directly sequential copies can be made at a time (in one copying presentation of) each document page for post-collation in a connecting plural bin sorter, to reduce the number of recirculations of the document sheets needed by the recirculating document handler for making plural copy sets.

The present system allows existing commercial duplex RDH's to have dual mode use, with different copying algorithms, to alternatively provide, with conventional plural sorter bins, a duplex post-collation copying system therewith, and thus eliminate the cost and duplication of hardware and spare parts normally required for a separate, special, non-RDH document handler with immediate inversion as is typically used for post-collation copying. Thus one copier with one document can be sold in in both pre-collation and post-collation versions.

The present duplex copying system has particular utility for "limitless sorting" post-collation copying, in which one set of sorter bins can be being filled with copy sheets to form respective collated copy sets therein, while the other set of bins is being unloaded.

In the disclosed post-collation duplex to duplex copying system a variable calculated number of plural identical copies per a circulation of said duplex original document sheets can be collated within approximately two circulations of said duplex original document sheets in a corresponding calculated variable plural number of said selected sorter bins, normally substantially less than the total number of sorter bins, to provide variable limitless sorting, and this is repeated with recalculations of said variable calculated number until the total quantity of said copy sets selected to be made has been completed.

With the general increases in speed and capabilities of modern copiers, there has been particularly provided improvements in automation, efficiency, speed and reliability in producing collated output, i.e., the output of copies of sets of original documents in collated copy sets, by various pre-collation or post-collation copying systems, as described in the references cited herein, and others.

The terms document, document sheet, or original, are used basically interchangeably in the descriptions herein, as referring to real, conventional, physical sheets of paper or the like sheet materials, usually flimsy, and usually but not necessarily image bearing. Documents may be either a true original or a previous copy being used as an original, sometimes called a "make ready". Unless specifically so indicated, they are not referring to electronic images, which are much more easily reordered and presented for copying than such real documents. Likewise, the respective "page" numbers illustrated on one side of a document and copy sheet here are not necessarily physical page numbers, they are explanatory visualizations of page order and/or controller count indicators. The term "document" here (and its first or second side or page number in the case of a duplex document) refers to the sheet or page being copied on the copier onto the corresponding "copy sheet", or "copy". The plural sheets of documents being copied in one commonly loaded set (which are usually, but not necessarily, collated), are referred to herein as a "document set" or "job". The "job" can also refers to the making of the requested number and type of copies made therefrom. A "simplex" document or copy sheet is one having an image or "page" on only one side or face of the sheet, whereas a "duplex" document or copy sheet has a "page", and normally an image, on both (its first and second) sides. The terms "first" and "second" sides are used herein for the opposite sides of a duplex document or copy sheet, and is consistent within a particular document set, but these terms are not intended or limited to "odd" vs "even" page sides, nor, unless specified, does not necessarily mean the order in which one particular set of sides is copied vs the other sides. It will be appreciated that for producing collated duplex copies (copy sets) of a duplex document set that the page or side order as well as the sheet order must be maintained, which adds difficulty and complexity to the job.

There is Xerox Corporation prior art on the basic concepts of a copier having both an RDH and a sorter, in combination, and with so-called "limitless sorting". Xerox Corporation U.S. Pat. No. 4,212,457, issued July 15, 1980 to J. Guenther, and 4,757,356 issued July 12, 1988, disclose RDH/sorter combinations. Said U.S. No. 4,212,457 to J. Guenther teaches switching between pre-collation and post-collation copying on the same apparatus, and in the paragraph bridging Cols. 1 and 2, specifically refers to post-collation limitless sorting with reference to cited Xerox Corporation U.S. No. 3,944,207 issued Mar. 16, 1976 to S. S. Bains on "limitless sorting". Limitless sorting is a known copying mode alternately using two sets of sorter bins, one of which sets of bins can be filled while the other set of bins is being unloaded, as explained in said 4,212,457 and 3,944,207. Limitless sorting using two separate sets or sections of bins, and copying the documents by a number of times equal to the smaller of the number of bins in a section or the number of collated copy sets required, is taught in Xerox Corporation U.S. No. 4,830,590 issued Aug. 20, 1974 to H. Harris, et al, originally filed in 1971. Said U.S. No. 4,212,457 to J. Guenther also teaches forward or reverse (1−N or N−1) copying order (Col. 1 lines 23 and 44–45, and Col. 4 lines 43–45 (the latter also mentioning duplex copying)), and cites an RDH which is an N−1 feeding order type (4,078,787 cited at Col. 2 line 25), although the illustrated RDH 10 of said 4,212,457 is apparently a 1−N order document feeding type. Said 4,757,356 is particularly noted as to the duplex document RDH cited in Col. 6 lines 14–20 and lines 30–33.

Also disclosing copier/RDH/sorter combinations with switching between pre-collation and post-collation copying on the same apparatus, as said U.S. No. 4,212,457 to J. Guenther, are Canon Japanese laid open applications 59-111171,27.6.1984 and 60-37-567,26.2 1985.

Limitless sorting and copy set collection post-collation using a 1 to N copying order RDH and a 12 bin sorter in which the alternative bins (every other bin, the odd numbered bins then the even numbered bins) are automatically unloaded in cycles is described in U.S. No. 4,358,197 issued Nov. 9, 1982 to W. Kukucka, et al, including automatic pause points.

Also of particular interest as relating to the subject of "limitless sorting" is U.S. No. 4,361,320 issued Nov. 30, 1982 to H Kikuchi, et al. It discloses a single vertical array of bins divided (functionally) into two groups when the number of copies to be collated exceeds the number of bins, thus allowing copying to operate continuously and allowing an operator to remove the collated copies from one group while copies are being collated in the other group. When the number of pages of a document exceeds a predetermined number, the first group is defined to contain more bins than the second group, thereby reducing the number of times each document page must be fed to the copier. A. J. Botte, et al., U.S. No. 4,285,591 issued Aug. 25, 1981 to IBM, is also programmed to automatically segment the collator job when the number of document sets desired exceeds the capacity of the collator.

It is important to keep in mind the important known differences between pre-collation and post-collation copying in automatically making plural collated sets of copies of a set of documents. Pre-collation copying does not require a sorter or collator for collating the copy output. The copy sets come out already collated and these completed sets may be put directly into an output set stacker and/or finisher. However, pre-collation with physical documents requires a recirculating document handler (RDH) to plurally recirculate the document set, since normally only one (or two) copy sets are produced per circulation of the document set. In contrast, in post-collation copying, plural copies can be made in direct sequence from each document (or 2-up document pair) in a single presentation to the copying or imaging station, but then sorting (collation) of the output copies is required. Duplexing requirements likewise differ between the two copying systems. Post-collation copying has particular problems with duplex copying which are addressed by the present system.

For example, if post-collation duplex to duplex copying were done in the same manner as normal pre-collation copying with an RDH, for making even two sets of duplex copy sheets four copying circulations of the duplex document set would be required. E.g., for an 8 page document set, in a first document circulation making only one copy of pages 7, 5, 3, 1; then in the second circulating making one copy of pages 8, 6, 4, 2; then a third circulation one copy of pages 7, 5, 3, 1; then in a fourth circulation one copy of pages 8, 6, 4, 2.

This pre-collation sequencing is inefficient and undesirable for post-collation copying, where plural identical copies can be made to reduce document recirculations. However, calculating a more efficient variable number of plural identical copies which can be made under various copying conditions for various different post-collation copying jobs without violating various sytem limitations is difficult, and heretofore believed impractical, especially for a conventional RDH document handler not doing immediate inversion of duplex documents, i.e., an RDH which must return inverted documents to the document stacking tray before they can be copied again. Also, efficient post-collation duplex to duplex copying was believed to be very difficult for a conventional copier with a limited capacity duplex tray, which limits the number of plural copies of sides 1's which can be stored therein. The number of copies per document side 1 per circulation times the number of documents in the document set being copied should not exceed the duplex tray sheet capacity.

Some examples of Xerox Corporation RDH Patents, including those with inversion paths or inverters for inverting duplex documents, are U.S. No. 4,278,344 issued July 14, 1981 to R. B. Sahay; 4,459,013 issued July 10, 1984 to T. J. Hamlin et al; 4,428,667; 4,621,801, 4,579,444, 4,579,325 and 4,579,326 (similar to the RDH shown herein); and 4,794,429. Some other examples of recirculating document handlers are disclosed in U.S. Pat. Nos.: 4,076,408; 4,176,945; 4,428,667; 4,330,197; 4,544,148; 4,462,527; and 4,466,733, and other art cited therein.

It is important to note that in a conventional or "racetrack" RDH, such as are primarily cited above, that the documents are restacked after copying on top of the stack of documents in the RDH document tray, and are fed out for copying from the bottom of the stack. This limits the document copying order to the N to 1 (N−1) order in which the set of documents are loaded into to the RDH tray (N to 1 from bottom to top, with page 1 face up and on top, and therefore fed last by the bottom feeder). This also limits and controls the duplex copying sequencing in comparison to a so-called "immediate duplex" document handler in which a duplex document sheet can be inverted and immediately returned back to the platen to copy the second side immediately after the first side, rather than waiting for another circulation of the entire document set to get that same document back to the platen again. An example of the latter on a copier with a sorter is shown in Fuji Xerox Japanese Appln. No. 57-131265 filed 29.7.1982 and laid open 6.2.1984 as No. 59-23352 by Y. Nanba.

As noted, the present invention is particularly suitable for copiers providing automatic duplex copying using dedicated duplex buffer trays in which the intermediately simplex copies are temporarily stored. Some examples of art on duplex tray duplexing (pre-collation) include, in addition to some of the patents above, Xerox Corporation U.S. No. 4,330,197 to Smith et al; 4,782,363 to Britt et al; and art cited therein.

The above-cited U.S. No. 4,278,344 to R. B. Sahay, although for a pre-collation system, is of particular interest in this regard as disclosing plural partial or buffer copy sets (first side copies) in the duplex buffer tray, the number of said plural buffer sets being a function of the total or maximum effective sheet capacity of that tray and a divisor of the number of duplex document sheets in the document set being recirculatively copied.

In said normal prior duplex document duplex copying systems, all the documents in the document set being copied are inverted by the RDH during one circulation of the document set. It is assumed by the copier controller that all the documents in the document set are duplex documents requiring inversion to copy both their first and second sides. Also, in said prior duplex document duplex copying systems normally all the documents in the document set are being copied on one side thereof in each circulation (at least, after the first circulation, which in some systems is a non-copying inverting and/or precounting circulation).

Examples of pre, post or post-collated output system features are also disclosed, for example, in the above-cited U.S. No. 4,782,363 issued Nov. 1, 1988 and filed Sept. 17, 1987 by James E Britt, et al, and U.S. No. 4,834,360 issued May 30, 1989 by T. Acquaviva, and prior art references cited therein, and elsewhere herein, and in the Xerox Corporation "5090" "9900" and "1090" copiers.

As to control systems, some examples of various other prior art copiers with document handlers with control systems therefor, including document sheet detecting switches, sensors, etc., are disclosed in U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. In an RDH a document set separator conventionally counts document set recirculations by signaling each time the last sheet of the set is fed, e.g., U.S. No. 4,589,645. It is well known in general and preferably to program and execute document handler and copier control functions and logic with conventional software instructions for conventional microprocessors. This is taught by the above and other patents and various commercial copiers. Such software may of course vary depending on the particular function and the particular software system and the particular microprocessor or microcomputer system being utilized, but will be available to or readily programmable by those skilled in the applicable arts without undue experimentation from either the provided verbal functional descriptions, such as those provided herein, or prior knowledge of those functions which are conventional, together with general knowledge in the software and computer arts. Controls may alternatively be provided utilizing various other known or suitable hardwired logic or switching systems.

The present invention overcomes various of the above-discussed and other problems, and provides various of the above-noted and other features and advantages.

A specific feature of the specific embodiment disclosed herein is to provide a method of copying a set of duplex (two sided) original document sheets with a recirculating document handler on a duplexing copier for making plural duplex (two sided) copy sheets, by loading the duplex document sheets into said recirculating document handler and circulating the document sheets to and from the copying station of the copier and automatically inverting the duplex document sheets to copy both their first and second sides with said recirculating document handler wherein said set of duplex document sheets is copied on their first and second sides in different, respective, circulations of said document sheets by said recirculating document handler, and wherein said copier makes duplex copies by temporarily storing the first side copies in a duplex buffer tray of the copier and feeding them out from said duplex buffer tray for copying the second sides thereof, the improvement comprising: an improved method of post-collation copying with a reduced number of circulations of the duplex original documents in said recirculating document handler, utilizing a multi-bin sorter operatively connecting with the copier in which said duplex copy sheets are collated into collated copy sets in selected said bins, wherein a calculated variable plural number of identical consecutive first side copies are respectively made of said duplex original document sheets per circulation thereof by said recirculating document handler, which calculated variable number of copies is a function of (1) the duplex tray sheet capacity (a preset constant) divided by the number of duplex original document sheets, and (2) the total quantity of said copy sets selected to be made.

Further specific features provided by the system disclosed herein, individually or in combination, include those wherein said calculated variable number of copies is also a function of (3) the number of available sorter bins, and (4) the remaining quantity of copy sets remaining to be made; and/or said variable calculated number of plural identical copies are collated within approximately two circulations of said duplex original document sheets; and/or with only one inversion of the documents; and/or in a corresponding calculated plural number of said selected sorter bins normally substantially less than the total number of said bins of said multi-bin sorter, to provide limitless sorting, and this is repeated with recalculations of said variable calculated number until the total quantity of said copy sets selected to be made has been completed and/or said calculated variable number of identical copies made of each document in a circulation of said duplex original document sheets and said calculated plural number of said sorter bins is a repeatedly recalculated function of the smallest of: (1) the duplex tray sheet capacity (a preset constant) divided by the number of originals, or (2) the quantity of copy sets selected to be made, or (3) the number of available sorter bins, or (4) the remaining quantity of copy sets to be made; and/or for a duplexing copier with connected plural sorter bins, utilizing a recirculating duplex document handler in which a set of duplex (two sided) original document sheets are loaded, recirculated, copied, and inverted during circulations, for making plural duplex (two sided) copy sheets therefrom, by making and temporarily storing a calculated variable plural number of identical consecutive first side copies of each document made in one circulation thereof in a duplex buffer tray of the copier, and feeding these copies out from the duplex tray for copying the second sides thereof in a subsequent document circulation, and outputting these copies to selected plural sorter bins, in which said plural identical copies are collated in a corresponding calculated plural number of said selected sorter bins normally less than the total number of bins; and in which said calculated variable number of identical copies made of each document in a circulation and said calculated plural number of said sorter bins is a repeatedly recalculated function of the smallest of: (1) the duplex tray sheet capacity (a preset constant) divided by the number of originals, or (2) the quantity of copy sets selected to be made, or (3) the number of available sorter bins, or (4) the remaining quantity of copy sets to be made; and/or in which said said calculated plural number of said selected sorter bins is normally substantially less than the total number of said connected plural sorter bins to provide a form of limitless sorting in which a variable number of completed collated copies are made in only two circulations of said original document sheets by said recirculating duplex document handler and can be removed from said calculated plural number of said selected sorter bins while a further calculated number copies are being made and collated in said other said connected plural sorter bins; and/or in which said variable calculated number of plural identical copies per a circulation of said duplex original document sheets are collated within approximately two circulations of said duplex original document sheets in said corresponding calculated plural number of said selected sorter bins, to provide variable limitless sorting, and this is repeated with recalculations of said variable calculated number until the total quantity of said copy sets selected to be made has been completed.

All references cited in this specification, and their references, are incorporated by reference herein where appropriate for appropriate teachings of additional or alternative details, features, and/or technical background.

Figure 1:
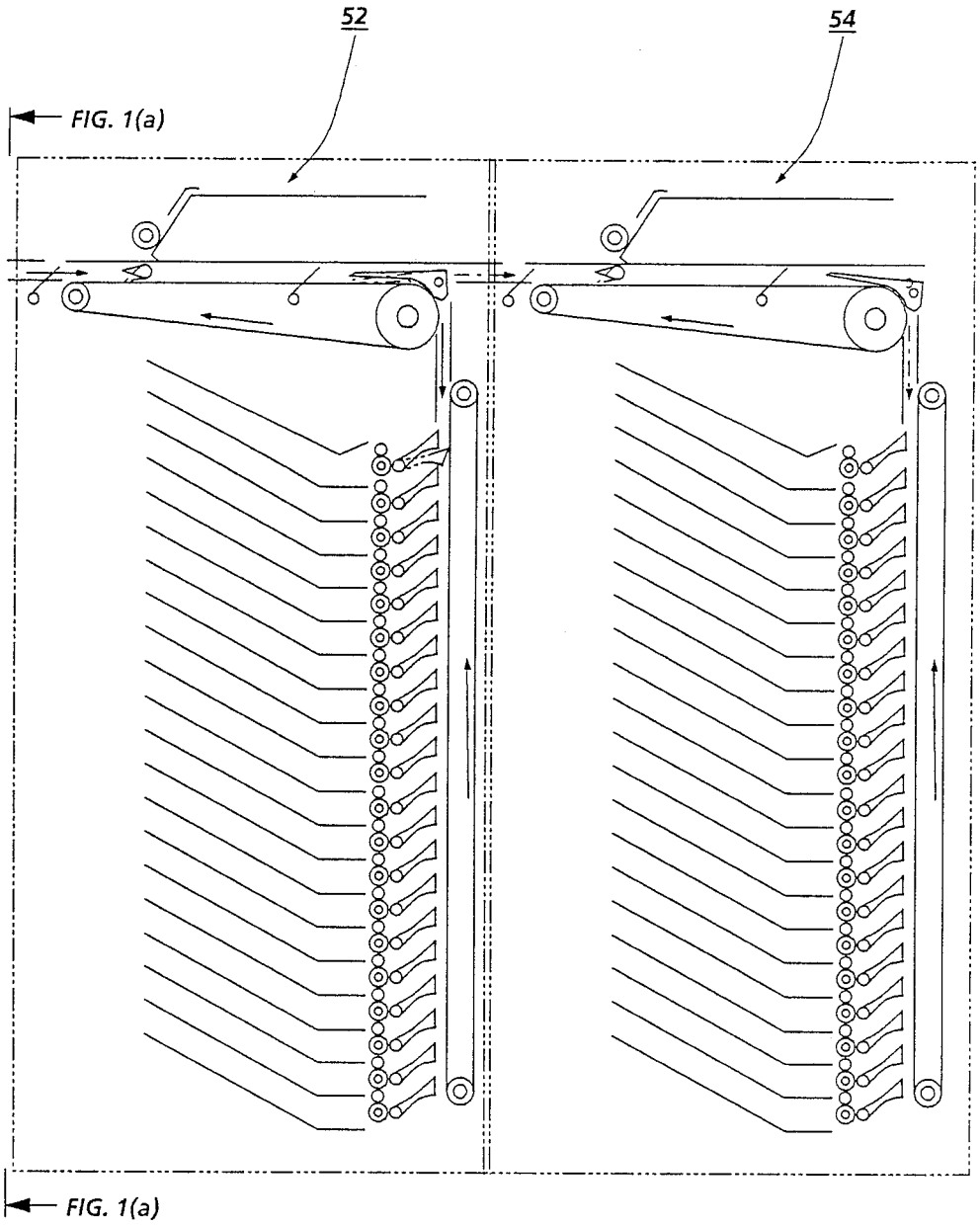
Figure 2:
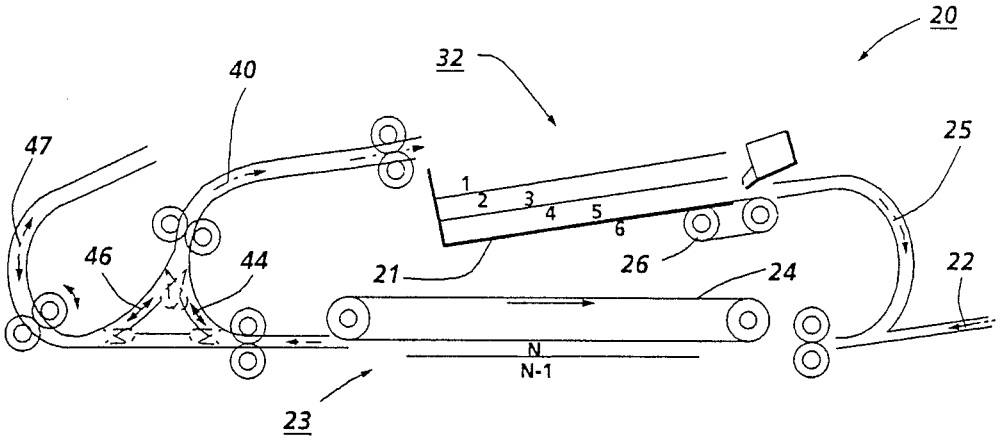

Various of the above-mentioned and further features and advantages of the invention will be apparent from the apparatus and its operation described in the specific example below. Thus, the present invention will be better understood from the following description of this exemplary embodiment thereof, including the drawing figures (approximately to scale) wherein:

FIG. 1 is a schematic frontal view showing in FIG. 1(*a*) an exemplary copier with duplexing, with an exemplary RDH providing duplex document inverting shown containing an exemplary set of duplex documents, and in FIG. 1(*b*) illustrating one example of serially connecting dual 20 bin sorters modules, for the subject post-collation copying system; and FIG. 2 is an enlarged view of the RDH of FIG. 1.

Describing now in further detail the specific example illustrated in the Figures, there is schematically shown in FIG. 1(*a*) an exemplary copier 10, with an exemplary recirculating document handler (RDH) 20, providing one example of the subject copying system. Both the copier 10 and RDH 20 are of a generally known type further described in art cited herein.

The exemplary copier 10 may be, for example, the well known Xerox Corporation "1075" or "1090" copiers, as illustrated and described in various patents cited above and otherwise, including 4,278,344, or various other xerographic or other copiers. Such a copier 10 is preferably adapted to provide in a known manner duplex or simplex collated copy sets from either duplex or simplex original documents circulated by the RDH 20. As is conventionally practiced, the entire document handler unit 20 may pivotally mount to the copier so as to be liftable by the operator up away from the platen for alternative manual document placement and copying.

The exemplary copier 10 and RDH 20 may alternatively be of various other similar or known types, such as are disclosed in above-cited patents. For example, the exemplary DH 20 structure illustrated here may be like that shown in U.S. No. 4,794,429 issued Dec. 27, 1988 to T. Acquaviva, or U.S. No. 4,731,637 issued Mar. 15, 1988 to T. Acquaviva and T. R. Cross. This general type of RDH is also shown in various cited and other patents thereon such as U.S. No. 4,579,444, etc.

For illustrative clarity here, the exemplary document and copy sheets are drawn here with exaggerated spacing between the document and copy sheets being stacked. In actual operation these stacked sheets would be directly superposed.

The RDH 20 provides for automatically feeding or transporting individual registered and spaced document sheets onto and over the imaging station 23, i.e., over the platen of the copier 10. For illustrative clarity here a platen is not fully illustrated in this schematic figure. The platen transport system 24 may be an incrementally servo motor driven non-slip or vacuum belt system controlled by the copier controller 100 in a manner taught by above-cited references to stop the document at a desired registration (copying) position.

The RDH 20 here has the conventional "racetrack" document loop path configuration, and preferably has generally known per se inverting and non-inverting return recirculation paths to the RDH loading and restacking tray 21. An exemplary set of duplex document sheets is shown stacked in this document tray 21. The RDH 20 is a conventional dual input RDH/SADH document handler, having an alternate semiautomatic document handling (SADH) side loading slot 22. Documents may be fed to the same imaging station 23 to be copied by the same platen transport belt 24 from either the SADH input 22 at one side of the RDH unit 20, or from the regular RDH input—the loading or stacking tray 21—on top of the RDH unit. As noted, that second input 22 is referred to herein as the SADH input 22, although it is not limited to semiautomatic document input feeding. The regular RDH document feeding input is from the bottom of the stack in tray 21 through an arcuate, inverting, RDH input path 25 to the upstream end of the platen transport 24. This input path 25 preferably includes a known stack bottom corrugating feeder—separator belt and air knife system 26, document position sensors, and a first set of turn baffles and feed rollers to naturally invert the documents once before copying.

Document inverting or non-inverting by the RDH may be as further described, for example, in the above-cited patents U.S. No. 4,794,429 or 4,731,637, etc. Briefly, after the documents are copied on the platen imaging station 23, or fed across the platen without copying, they may be ejected by the platen transport system 24 into downstream or off-platen rollers and fed past a gate or gates and sensors. Depending on the positions of these gates, they either guide the documents straight out directly to a document output path to a catch tray, or, more commonly, the documents are instead deflected by a decision gate past a further sensor into an RDH return path 40 taking them back to tray 21 to restack on top of the documents then in tray 21, so that the document set can be continuously refed and recirculated. This RDH return path 40 includes reversible rollers to provide a choice of two different return paths to the RDH tray 21; a simplex return path 44 with one inversion, or a reversible duplex return path 46 without an inversion (called an inverter), as further explained below. For the duplex path 46 the reversible rollers are reversed to reverse feed the previous trail edge of the sheet back into the duplex return path 46 from an inverter chute 47 (curved in this case). This duplex return path 46 provides a desired inversion of duplex documents in one circulation, as they are returned to the tray 21, as compared to their previous orientation in tray 21, for copying their opposite sides in a subsequent circulation, or circulations, as described in the above-cited art. Normally this RDH inverter and inversion path 46, 47 is used only for RDH input tray 21 loaded documents and only for duplex documents. In normal operation a duplex document has only one inversion per circulation (occurring in the RDH input path 24). In contrast, in the simplex circulation path there are two inversions per circulation, one in each of the paths 24 and 44. Two inversions per circulation equals no inversion. Thus, simplex documents are returned to tray 21 in their original (face up) orientation via the simplex path 44.

The entire stack of originals in the RDH tray 21 can be plurally recirculated and copied to produce plural collated copy sets. The document set or stack may be RDH recirculated any number of times to produce any desired number of collated duplex copy sets. That is, collated sets of duplex copy sheets.

Referring further to the exemplary copier or duplicator 10 here, since such copier operation and apparatus is known and taught in the cited and other art it need not be re-explained in detail herein. Blank or clean copy sheets can be conventionally fed from paper trays 11 or 12 (or the high capacity feeder tray shown thereunder) to receive an image on their first sides from photoreceptor 13 at transfer station 14, to be fused in a fuser 15 and temporarily stacked in a duplex buffer tray 16 for subsequent return (inverted) via path 17 therefrom for receiving a second side image in the same manner as the first side. As noted herein, this duplex tray 16 has a finite predetermined sheet capacity, depending on the particular copier design. The completed duplex copy is preferably exited to an integral finishing and stacking module via output path 18. An optionally operated copy path sheet inverter 19 is also provided.

Here the copier 10 output path 18 is directly connected in a conventional manner to two serially connected generally conventional 20 bin sorters 52 and 54, shown in FIG. 1(*b*). Xerox Corporation U.S. No. 3,467,371 issued Sept. 16, 1969, to J. E. Britt et al, shows a similar sorter arrangement. The two vertical bin arrays are conventionally gated to deflect a selected sheet into a selected bin as the sheet is conventionally transported past the bin entrance. An illustrated optional gated overflow top stacking or purge tray is also provided for each of the bin sets or modules 52 and 54. Conventionally, the first bin set 52 may be bypassed by actuation of a gate therein to direct sheets serially on to the second bin set 54, to increase the total number of bins available, and/or to alternatingly use the two bin sets for "limitless sorting", as described above.

All copier and document handler and sorter operations are preferably controlled by a generally conventional programmable controller 100. The copier 10 and its RDH 20 here are additionally programmed with certain novel functions described herein. The controller 100 preferably comprises a known programmable microprocessor system, as exemplified by the above cited and other extensive prior art, e.g., U.S. No. 4,475,156 and its references. The controller 100 controls all of the machine steps and functions described herein, including all sheet feeding. This includes the actuations of the document and copy sheet feeders and inverters, gates, etc. As further taught in the references, the controller 100 also conventionally provides for storage and comparison of the counts of the copy and document sheets, the number of documents fed and recirculated in a document set, the desired number of copy sets, and other selections by the operator through a connecting panel of numerical and other control of function selection switches. Controller information and sheet path sensors are utilized to control and keep track of the positions of the respective document and the copy sheets and the operative components of the apparatus by their connection to the controller. The controller may be conventionally connected to receive and act upon jam, timing, positional, and other control signals from various sheet sensors in the document recirculation paths and the copy sheet paths. The controller automatically actuates and regulates the positions of sheet path selection gates depending upon which mode of operation is selected and the status of copying in that mode. The controller 100 also conventionally operates and changes displays on a connecting instructional display panel portion thereof, which preferably includes said operator selection buttons or switches. Here this machine controller 100 preferably includes a known touch-screen type of integrated operator input control and display.

A conventional document set separator in the RDH, connected to the controller 100, conventionally provides a signal indicating that the last sheet of the document set has been fed i.e., a signal each time one complete document set circulation has been completed. See, e.g., U.S. No. 4,589,645.

Turning now to the specific example of the system disclosed herein, this is a post-collation duplex copying system, wherein in one pass or circulation of the documents, plural identical copies are of each document are desirably made in direct sequence and put into a duplex buffer tray, and then in the next document set circulation all these copies are fed out of the duplex tray so that the other sides of the duplex documents can be copied onto all of the other sides of the copy sheets fed from the duplex tray, and these plural identical uncollated duplexed copy sheets then being separately placed in separate bins of a sorter or collator for post-collation. However, in practice, this must be done differently, and repeated, to produce a desired number of copies under different copying circumstances, as will be described herein. Thus heretofore, it was not conventional or practical to make duplex copies to be collated in a sorter from duplex originals recirculated in an RDH. The difficulties in doing so will be more fully seen apparent from the complexity of the operational algorithm and examples described herein.

The illustrated operation of the copier 10 here is for one example of the subject duplex to duplex post-collation copying mode. There is shown by way of one example a xerographic copier type of reproducing machine 10 feeding and copying a sample document set 32 comprising conventional duplex document originals numbered here $\frac{1}{2}$, $\frac{3}{4}$, 5/6, [etc.], to the N−1/Nth document sheet. They are show as initially loaded into the RDH 20 tray 21 in FIG. 1(*a*), and in FIG. 2 are shown in copying the first (N−1/Nth) document to be copied.

As described and shown, this document set 32 is conventionally loaded into the RDH 20 tray 21, and the bottom sheet is then fed out to the imaging station 23 and copied there on its exposed first side, and the copy thereof is put into the duplex tray 16. For illustrative purposes, an exemplary set of intermediately simplex (duplex buffer set) copy sheets is shown in the duplex tray 16 in phantom. The second sides of the documents are then copied onto these sheets from the duplex tray 16 in a subsequent circulation of the document set, i.e., after the documents have been inverted so that their second sides can be copied.

As noted, a conventional recirculating document handler, as here, has its duplex document inversion occuring on the way back to the top document feeder. This mechanical hardware restriction and the duplex tray capacity restriction needs a unique algorithm for running 2 sided to 2 sided post-collation jobs with the document handler (duplex-to-duplex mode). However, the use of the RDH enables a type of "limitless sorting".

The desired features of this algorithm are to: (1) minimize recirculations of the documents; and (2) maximize productivity, i.e., minimize copier dead cycles or skipped pitches. This algorithm will be described, and an example provided.

An algorithm satisfying these requirements in a copier with duplex buffer tray duplexing and a normal RDH duplex document copying order has additional requirements for post-collation duplex copying as follows: Copies of side 1's (the first document side copied) are sent to the copier's duplex tray to wait for side 2 copying, as described above. Since side 2 of the document will not be available until the rest of the document stack has been recirculated in the document handler, as described above, the duplex tray must hold all side 1 copies of all document sheets, N though 1. The number of copies of each original that can be made per pass (in one circulation of the documents) is a function (F) of the duplex tray capacity, the number of originals in the document set being copied, the number of copies selected to be made, and the limits of the sorter (the maximum usable number of sorter bins available of the particular copier/sorter).

Therefore: The number of copies made per original in the current document set circulation (the number of consecutive document flashes or scans) =F (duplex tray capacity; number of originals; number of sorter bins; and remaining quantity of copy sets to be copied). Where F=smallest of: [see definitions below]

(1) duplex tray capacity÷number of originals
(2) quantity selected
(3) number of sorter bins
(4) Remaining quantity of copy sets Assume here for this example that the "duplex tray capacity"=100 (for this exemplary copier). This particular number is a function of the particular copier used.

The "number of originals" is a number determined by a conventional precount (an initial counting circulation of the document set in the RDH), or by a numerical key entry by the copier operator. {Unless the "quantity selected" is only one copy set.}

The "quantity selected" is the total quantity of copy sets selected to be made. This information was stored in the controller from the initial numerical key entry by the copier operator for the number of desired copies.

The "number of sorter bins" is the maximum number of sorter bins available to put copy sheets into at that point in time. Here, in this example, for this particular sorter, this number is either 20 or 40, depending on whether there are provided one or two 20 bin sets or modules of sorters (This number is a preset selection in non-volatile memory by the service representative at the initial installation of the copier/sorter unit), OR the number of remaining (unfilled) bins in the sorter module, whichever is less.

The "remaining quantity of copy sets" is the remaining quantity of copy sets to be made at this point (in the present document set circulation). It is determined by the formula: remaining quantity of copy sets=(quantity selected-quantity already made).

For one example of a scheduling sequence, assume examples of numbers for the above algorithm as follows:

duplex tray capacity=100
number of originals=30
quantity selected=10
number of sorter bins =20.

Therefore, for this example, applying the formula, F=smallest of: (1) duplex tray capacity÷number of originals, (2) quantity selected, (3) number of sorter bins, or (4) remaining quantity of copy sets=duplex tray capacity÷number of originals (=100÷30 here), and therefore the number of copies made per original (flashes per original) in this example=100÷30=3. (Except for the last or closeout circulations, for the final "remaining quantity of copy sets", as will be shown.)

The actual copying sequences for this particular example will now be illustrated below. These examples are used or written with scheduler acronyms in the form of "Cx,y,z". The following is the key to these scheduler acronyms:

C=Commit (commit copy sheet to paper path)
x=sheet number
y=side number
z=set number.

(Thus, for example, C2,2,4 means commits sheet number 2, side 2, of copy set number 4 to the paper path.)

First document set circulation copies:
C1,1,1 C1,1,2 C1,1,3 C2,1,1 C2,1,2 C2,1,3 . . . C29,1,1 C29,1,2 C29,1,3 C30,1,1 C30,1,2 C30,1,3
(Note: All of these 90 copy sheets go into the duplex tray. These copy sheets are the three identical side 1 copies of each document for copy sets 1 through 3, in this example. Meanwhile the RDH has inverted each duplex document after its removal from the platen, in preparation for the second document circulation.)

Second document circulation copies:
C1,2,1 C1,2,2 C1,2,3 C2,2,1 C2,2,2 C2,2,3 . . . C29,2,1 C29,2,2 C29,2,3 C30,2,1 C30,2,2 C30,2,3
(These are the side 2 copies of copy sets 1 through 3. All of these 90 sheets are fed from the duplex tray to be second side copied and then fed to the copier output and on sequentially to three respective sorter bins 1,2,3 for collation of these three sets being made at a time in this example. Meanwhile, the documents are inverted again (and in the subsequent circulations).)

Third document circulation copies:
C1,1,4 C1,1,5 C1,1,6 C2,1,4 C2,1,5 C2,1,6 . . . C29,1,4 C29,1,5 C29,1,6 C30,1,4 C30,1,5 C30,1,6
(All these sheets are going to the duplex tray. These are side 1 copies of copy sets 4 through 6.)

Fourth document circulation copies:
C1,2,4 C1,2,5 C1,2,6 C2,2,4 C2,2,5 C2,2,6 . . . C29,2,4 C29,2,5 C29,2,6 C30,2,4 C30,2,5 C30,2,6
(All sheets fed from duplex tray to output after copying. These are side 2 copies of copy sets 4 through 6, respectively going into sorter bins 4,5,6.)

Fifth document circulation copies:
C1,1,7 C1,1,8 C1,1,9 C2,1,7 C2,1,8 C2,1,9 . . . C29,1,7 C29,1,8 C29,1,9 C30,1,7 C30,1,8 C30,1,9
(All sheets going to duplex tray. These are side 1 copies of copy sets 7 through 9.)

Sixth document circulation copies:
C1,2,7 C1,2,8 C1,2,9 C2,2,7 C2,2,8 C2,2,9 . . . C29,2,7 C29,2,8 C29,2,9 C30,2,7 C30,2,8 C30,2,9
(All sheets fed from duplex tray, copied, and on to output. These are side 2 copies of copy sets 7 through 9, going into bins 7,8,9. Note that the "remaining quantity of copy sets" at this point for this example is one set set number 10.)

Seventh document circulation copies.
C1,1,10 C2,1,10 . . . C29,1,10 C30,1,10

(All these 30 copy sheets are going into the duplex tray. These are side 1 copies of copy set 10 only (the last copy set).)

Eighth document circulation copies:

C1,2,10 C2,2,10 . . . C29,2,10 C30,2,10

(These are the side 2 copies of the last copy set 10. These are the same 30 sheets as in the seventh document circulation, now being fed from the duplex tray to be second side copied and outputted to bin 10.)

To provide another example, again assume a 100 sheet duplex tray capacity, only this time 50 copy sets are required from a 16 page original documet set. 100÷16=6 copies to be made at a time of each of the sides 1's and put into the duplex tray, plus a rounded-down integer remainder of 4 to be made in the last two circulations.

Note that here, as also shown in the previous example, only a limited number of the total number of bins (6 bins here) are being used at a time, until these last 4 remainder copy sets are made. Since only 6 identical copies are being made at a time, only 6 bins at a time are need for collaton, for this job, since the above calculated buffer size here was 6. Thus, here copy sets 1–6 can be loaded into bins 1–6. Then copy sets 7–12 can be loaded into bins 7–12. Then copy sets 13–18 can be loaded into bins 13–18. At this point, assuming only 20 total bins were available in this case (using only one 20 bin set or array), only 2 are left and the number of available bins is less than the calculated buffer size. Thus two copies per original can be made at this point (copy sets 19 and 20), instead of 6, and loaded into bins 19 and 20. Meanwhile, if bins 1–6 have now been unloaded (per displayed instructions to the operator to do so) then the copier can automatically continue on without pausing to make and load copy sets 21–27 into bins 1–6, etc., etc., until all the 50 copy sets requested here in this example have been completed. Or, if the illustrated second set of 20 bins is utilized, then those bins can be loaded next, before bins 1–6 of the first bin set are needed to be used again. It may be seen that this 50 copy set example with either one or two 20 bin sorters was run with the following buffer sizes (numbers of identical copies per document per circulation): 6,6,6,2; 6,6,6,2; 6,4=50 copy sets.

It may be seen that an automatically variable bin set number type of "limitless" sorting system is automatically provided here in which the number of bins being used at one time is, in most cases, less than the number of bins available. The job is effectively divided into job sub-sets using different sizes of bin sub-sets. To express this generically, this is a type of "limitless" sorting in which the number of bins (the bin sub-set) used for each job is determined from the duplex tray capacity and the number of documents being copied, rather than the number of bins in a bin array or fixed subset of bins as in normal "limitless" sorting. [Unless this calculated number of bins needed for the job is greater than the available number of bins in the bin set.]

If desired, pre-programmed pause points and displayed operator instructions may be provided to provide additional time for bin unloading, or special inserts, in some cases. Furthermore, with additional operator input and software, the copier could be programed so that even another job can be started or run using the other available bins while the prior job is being unloaded from these utilized bins.

Turning now to an example of generalized software instructions for implementing this general algorithm in a controller or other computer, one is as follows:

```
Procedure/Processes: Determine duplex Buffer
Description: Called up when job is started and before next buffer
set (job subset) is run (i.e., run for each job subset)
{Note; ** = notes, not instructions.}
ENTER:
Buffer sets required =
                    CALCULATE[100* ÷ the number of originals];
*(100 is the duplex tray capacity in this example)
**[NOTE: The result of this division returns the truncated
whole number (integer) part of the calculation.]
IF
buffer sets required > quantity selected [the number of copies
programmed in by the operator];
THEN
buffer sets required = quantity selected
IF
buffer sets required > available bins;
THEN
buffer sets required = available bins;
IF
(set number [the number of the particular copy set then being
                made] + buffer sets required) > quantity selected;
**[This is a dynamic safety check for the end of job.]
THEN — **[Don't need that many buffer sets.]
buffer sets required = (quantity selected — set number);
END THIS PROCEDURE: Determine buffer.

Further procedures/processes for ADH duplex to duplex:
IF
present bin being loaded ≠ 20*;
*[This number is preset to the maximum number of bins available.
20 is the number of bins for the sorter module in this particular
example.]
THEN — **[Not doing a forced switch to next bin array, so
recalculate buffer set requirement.]
IF
(present bin being loaded + buffer sets
                                    required) > available bins;
THEN
(buffer sets required) = available bins — present bins;
IF
(set number + buffer sets required) > quantity selected
THEN — **[Check to see if near the end of the job.]
buffer sets required = quantity selected — set number;
END
```

As a general note, it should be noted that the subject system here is not limited to a pure duplex to duplex system in all cases or modes. It can also include or incorporate some special cases of specially programmed intermixed simplex originals or simplex copies, which can be an extension of this basic duplex to duplex algorithm. For example, chapterization, or tab inserts. The copying system herein can be automatically tied by the controller 100 to suitable tabbing or covers inserts and/or "chapterization" of subsets of copy sheets. For example, the commonly assigned and substantially concurrently filed application by the same K. M. Rabb, et al, Ser. No. 445,819, on handling simplex tab originals and simplex tab copies intermixed with normal duplex originals and duplex copies. "Chapterization" is automatically providing the beginning of a subset or chapter within a copy set on the facing page immediately following the last page of a chapter end or a tab insert sheet, so that the beginnings of chapters are conventionally started on a right hand side page following an appropriately positioned blank (simplexed) left side copy sheet page, even if intermixed with otherwise duplexed copies. An example of "chapterization" (for a pre-collation system), is described in U.S. Pat. No. 4,640,607 issued Feb. 3, 1987 to Richard L. Bray (Eastman Kodak Company).

The present system allows existing commercial RDH's to alternatively be used "as is", for cost savings, with a new copying algorithm, to alternatively provide, with conventional plural sorter bins, a duplex post-collation copying system. Thus, the RDH document handler can have dual mode use and eliminate the cost and duplication of hardware and spare parts for a separate, special, non-RDH document handler with immediate inversion as is typically used for post-collation copying. Thus, one copier with one document handler can be sold in both pre-collation and post-collation versions. The present system minimizes the number of document recirculations and maximizes productivity in duplex to duplex post-collation copying using an RDH.

While the embodiment disclosed herein is preferred, it will be appreciated from this teaching that various alternatives, modifications, variations or improvements therein may be made by those skilled in the art, which are intended to be encompassed by the following claims.

We claim:

1. In a method of copying a set of a number of duplex (two sided) original document sheets with a recirculating document handler on a duplexing copier for making a selected plural quantity of duplex (two sided) copy sheets, by loading said duplex original document sheets into said recirculating document handler and circulating said duplex original document sheets to and from a copying station of the copier and automatically inverting said duplex original duplex document sheets to copy both their first sides and second sides to make first side copies and second side copies with said recirculating document handler, wherein said set of duplex original document sheets is copied on their first and second sides in different, respective, circulations of said duplex original document sheets by said recirculating document handler, and wherein said copier makes said duplex copy sheets by temporarily storing the first side copies in a duplex buffer tray of said copier having a defined sheet capacity and feeding them out from said duplex buffer tray for copying the second sides thereof; an improvement comprising:

an improved method of post-collation copying, with a reduced number of said circulations of said duplex original document sheets in said recirculating document handler, utilizing a multi-bin sorter with a number of available bins operatively connecting with said copier in which said duplex copy sheets are collated into collated copy sets in selected bins of said multi-bin sorter, wherein a calculated variable plural number of identical consecutive said first side copies are respectively made of said duplex original document sheets per said circulation thereof by said recirculating document handler, which calculated variable number of first side copies is a function of: (1) the sheet capacity of said duplex buffer tray (a preset constant number) divided by said number of said plural duplex original document sheets in said set thereof, (2) said selected quantity of duplex copy sheets (3) the number of available said bins of said multi-bin sorter, and (4) the quantity of said sets of duplex copy sheets remaining to be made.

2. The post-collation duplex to duplex copying method of claim 1, in which said calculated variable plural number of identical first side copies are copied on their second sides and collated within approximately two said circulations in a corresponding calculated plural number of said bins of said multi-bin sorter, to provide limitless sorting, and this is repeated with recalculations of said calculated variable number until said selected quantity of said duplex copy sheets has been completed.

3. The post-collation duplex to duplex copying method of claim 2, in which said calculated variable plural number of identical first side copies is made of each said duplex original document sheet per said circulation of said duplex original document sheets, and said corresponding calculated plural number of said bins of said multi-bin sorter is a repeatedly recalculated function of the smallest of: (1) the sheet capacity of said duplex buffer tray (a preset constant number) divided by said number of said duplex original document sheets in said set thereof, or (2) said selected quantity of plural sets of duplex copy sheets, or (3) the number of said bins of said multi-bin sorter available, or (4) the number of said selected quantity of plural sets of duplex copy sheets remaining to be made.

4. An improved post-collation duplex to duplex copying system, for a duplexing copier with a number of connected plural sorter bins, utilizing a recirculating duplex document handler in which a set of duplex (two sided) original document sheets are loaded, recirculated, copied, and inverted during circulations, for making a selected plural quantity of duplex (two sided) copy sheets therefrom, by making and temporarily storing a calculated variable plural number of identical consecutive first side copies of each said document sheet made in one said circulation thereof in a duplex buffer tray of said copier having a defined sheet capacity, and feeding these copies out from said duplex tray for copying their second sides in a subsequent said circulation, and outputting these copies to selected bins of said plural sorter bins, in which said calculated variable plural number of identical copies are collated in a corresponding calculated plural number of said selected bins of said plural sorter bins normally less than said number of said connected plural sorter bins, in which said calculated variable plural number of identical copies and said corresponding calculated variable plural number of said selected bins of said plural sorter bins is a repeatedly recalculated function of the smallest of: (1) the sheet capacity of said duplex buffer tray (a preset constant number) divided by the number of document sheets in said set of duplex original document sheets, or (2) said selected plural quantity of copy sheets to be made, or (3) the number of said connected plural sorter bins which are available, or (4) the number of said selected plural quantity of copy sheets remaining to be made.

5. The improved post-collation duplex to duplex copying system of claim 4 in which said said corresponding calculated variable plural number of said selected bins of said plural sorter bins is normally substantially less than the total number of said connected plural sorter bins to provide a form of limitless sorting in which a variable number of completed collated copies are made in only two said circulations of said duplex original document sheets by said recirculating duplex document handler and can be removed from said calculated variable plural number of said selected bins while a further calculated number of copies are being made and collated in other said bins of said connected plural sorter bins.

6. The improved post-collation duplex to duplex copying system of claim 4, in which said calculated variable plural number of identical copies per one said circulation of said duplex original document sheets are collated within approximately two said circulations of said duplex original document sheets in said corresponding calculated plural number of said selected bins of said plural sorter bins, to provide variable limitless sorting, and this is repeated with recalculations of said calculated variable number until said selected plural quantity of copy sheets has been made.

7. The improved post-collation duplex to duplex copying system of claim 6 in which said said corresponding calculated variable plural number of said selected bins of said plural sorter bins is normally substantially less than the total number of said connected plural sorter bins to provide a form of limitless sorting in which a variable number of completed collated copies are made in only two said circulations of said duplex original document sheets by said recirculating duplex document handler and can be removed from said calculated variable plural number of said selected bins while a further calculated number of copies are being made and collated in other said bins of said connected plural sorter bins.

* * * * *